US010876790B2

(12) United States Patent
Fluellen

(10) Patent No.: US 10,876,790 B2
(45) Date of Patent: Dec. 29, 2020

(54) BALLISTIC VEST COOLING ASSEMBLY

(71) Applicant: Curtis Fluellen, Mulberry, FL (US)

(72) Inventor: Curtis Fluellen, Mulberry, FL (US)

( * ) Notice: Subject to any disclaimer, the term of this patent is extended or adjusted under 35 U.S.C. 154(b) by 85 days.

(21) Appl. No.: 16/238,872

(22) Filed: Jan. 3, 2019

(65) Prior Publication Data

US 2020/0217584 A1 Jul. 9, 2020

(51) Int. Cl.
*F25D 31/00* (2006.01)
*F25D 29/00* (2006.01)
*F41H 1/02* (2006.01)

(52) U.S. Cl.
CPC ..... *F25D 31/00* (2013.01); *F25D 29/003* (2013.01); *F41H 1/02* (2013.01); *F25D 2400/26* (2013.01)

(58) Field of Classification Search
CPC .... F25D 31/00; F25D 29/003; F25D 2400/26; F41H 1/02
USPC ..... 62/259.3
See application file for complete search history.

(56) References Cited

U.S. PATENT DOCUMENTS 3,079,765 A * 3/1963 Le Vantine ..... B64G 6/00 62/259.3
4,457,295 A * 7/1984 Roehr ..... A41D 13/0051 126/204
4,964,282 A 10/1990 Wagner
5,970,519 A * 10/1999 Weber ..... A41D 13/0025 2/102
5,977,517 A 11/1999 Grosjean
6,105,382 A 8/2000 Reason
6,260,201 B1 * 7/2001 Rankin ..... A41D 13/0025 2/272
6,363,527 B1 4/2002 Biermann et al.
6,874,332 B2 4/2005 Forgach
7,437,883 B1 10/2008 Baldal
7,823,625 B2 * 11/2010 Gammons ..... F16L 37/0841 165/46
7,827,624 B1 * 11/2010 Cole ..... A41D 13/0053 2/458
7,918,103 B1 * 4/2011 Purvis ..... A47C 21/044 62/259.3
9,772,166 B2 9/2017 Shelton
2005/0139351 A1 * 6/2005 Chambers ..... A62B 17/005 165/297
2005/0246826 A1 * 11/2005 McCarter ..... A41D 13/0053 2/458

(Continued)

*Primary Examiner* — Steve S Tanenbaum

(57) ABSTRACT

A ballistic vest cooling assembly includes a ballistic vest that is comprised of a bullet resistant material to protect a user from a bullet. A plurality of tubes is integrated into the ballistic vest and the plurality of tubes contains a fluid. A sleeve is positioned around the plurality of tubes to define an air space between the sleeve and the plurality of tubes. A temperature conditioning unit is coupled to the ballistic vest and the temperature conditioning unit is in fluid communication with the sleeve. The temperature conditioning unit blows air through the sleeve when the temperature conditioning unit is turned on for cooling the user when the user wears the ballistic vest. A control unit is selectively placed in electrical communication with the temperature conditioning unit for turning the temperature conditioning unit on and off. Additionally, a remote control is in wireless electrical communication with the control unit for remotely controlling the temperature conditioning unit.

9 Claims, 7 Drawing Sheets

(56) References Cited

U.S. PATENT DOCUMENTS

| | | | | |
|---|---|---|---|---|
| 2007/0136922 | A1* | 6/2007 | Oliver | A62B 17/005 2/69 |
| 2009/0199571 | A1* | 8/2009 | Creech | A61F 7/02 62/3.2 |
| 2010/0223943 | A1* | 9/2010 | Loukaides | A41D 13/0053 62/259.3 |
| 2010/0287681 | A1* | 11/2010 | Storms, Jr. | F41H 1/02 2/102 |
| 2011/0239346 | A1 | 10/2011 | Doherty | |
| 2014/0305148 | A1* | 10/2014 | Paull | A41D 13/0056 62/91 |
| 2016/0255884 | A1* | 9/2016 | Chaumont | A01K 13/008 |

* cited by examiner

BALLISTIC VEST COOLING ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to vest cooling devices and more particularly pertains to a new vest cooling device for cooling a ballistic vest when the ballistic vest is worn.

BRIEF SUMMARY OF THE INVENTION

An embodiment of the disclosure meets the needs presented above by generally comprising a ballistic vest that is comprised of a bullet resistant material to protect a user from a bullet. A plurality of tubes is integrated into the ballistic vest and the plurality of tubes contains a fluid. A sleeve is positioned around the plurality of tubes to define an air space between the sleeve and the plurality of tubes. A temperature conditioning unit is coupled to the ballistic vest and the temperature conditioning unit is in fluid communication with the sleeve. The temperature conditioning unit blows air through the sleeve when the temperature conditioning unit is turned on for cooling the user when the user wears the ballistic vest. A control unit is selectively placed in electrical communication with the temperature conditioning unit for turning the temperature conditioning unit on and off. Additionally, a remote control is in wireless electrical communication with the control unit for remotely controlling the temperature conditioning unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
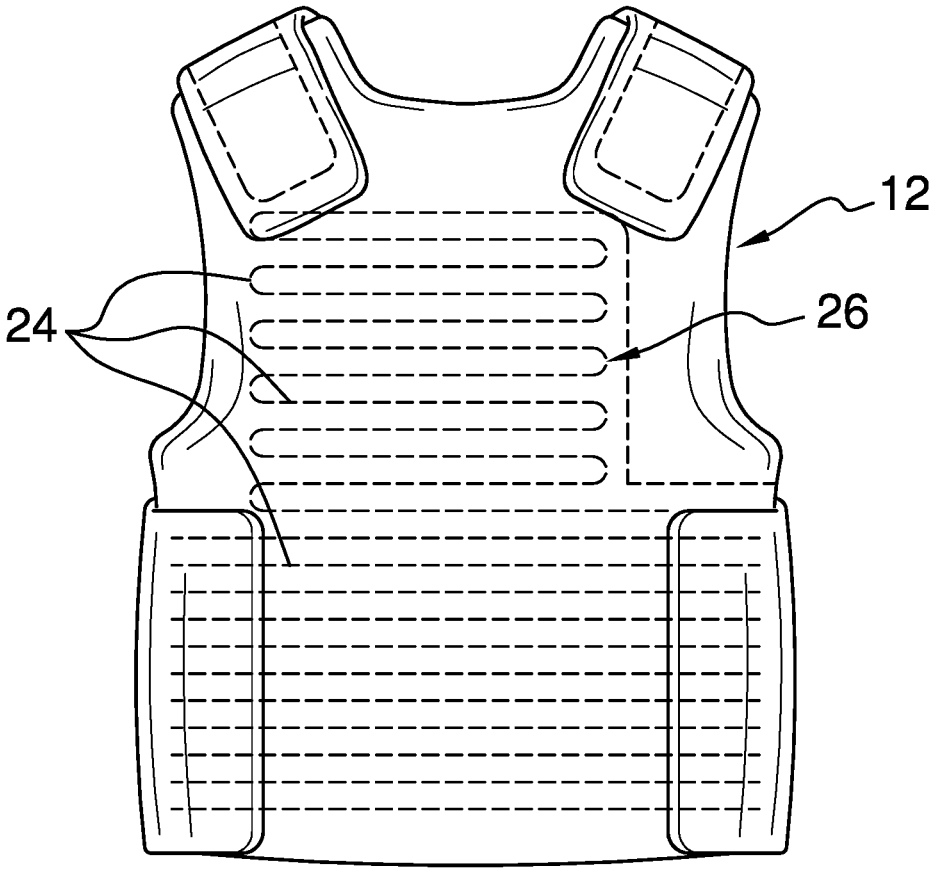
FIG. 1 is a front phantom view of a ballistic vest cooling assembly according to an embodiment of the disclosure.
Figure 2:
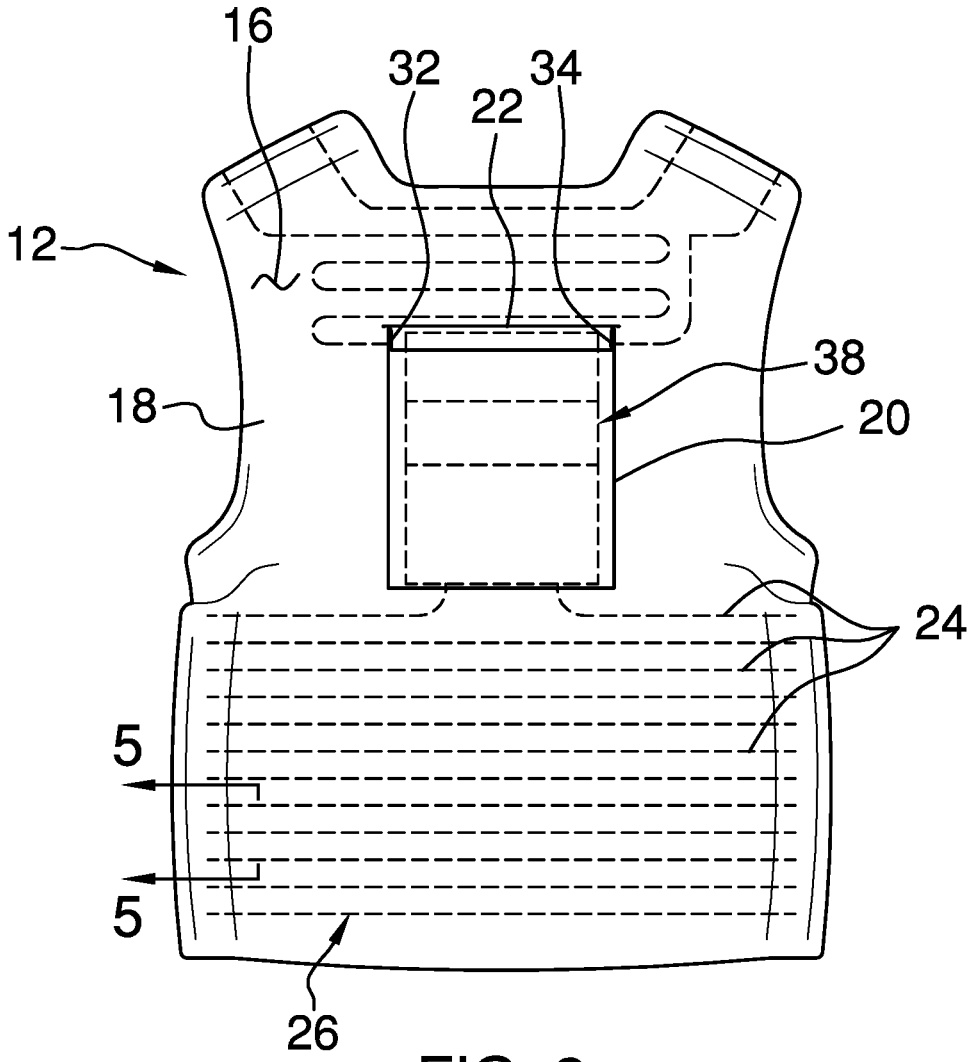
FIG. 2 is a back phantom view of an embodiment of the disclosure.
Figure 3:
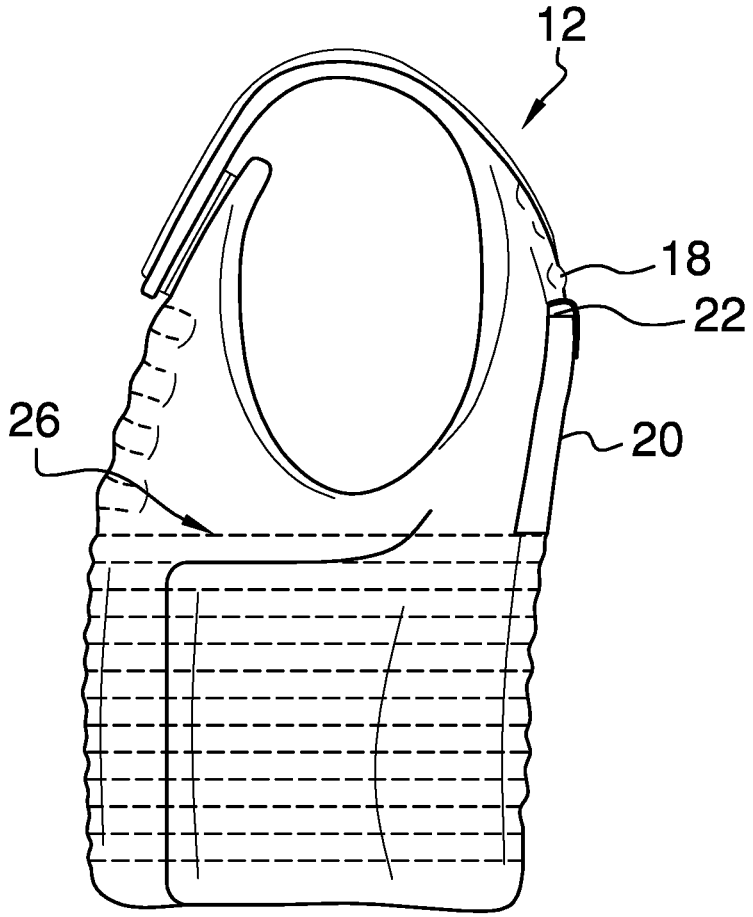
FIG. 3 is a left side phantom view of an embodiment of the disclosure.
Figure 4:
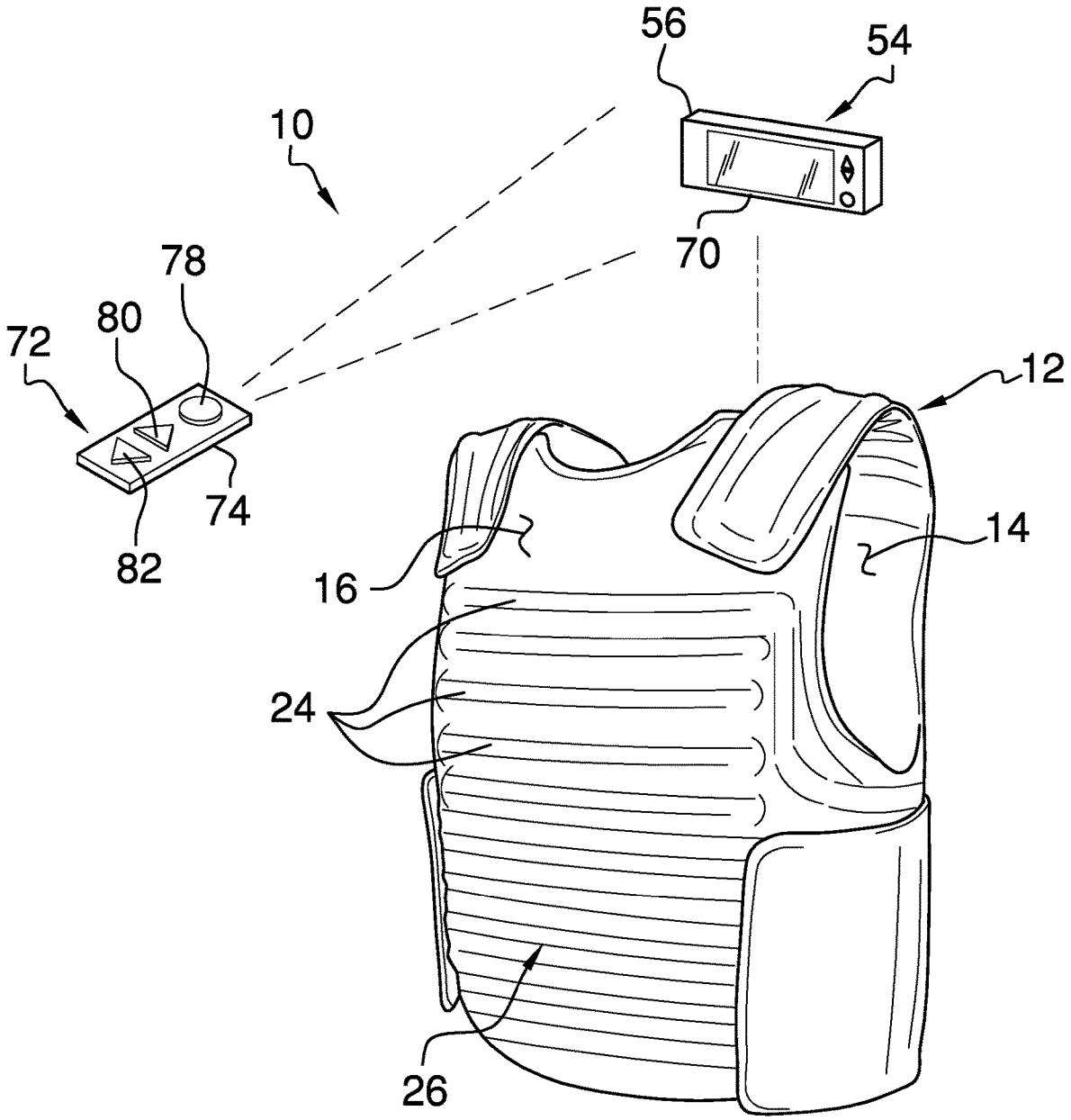
FIG. 4 is a perspective view of an embodiment of the disclosure.
Figure 5:
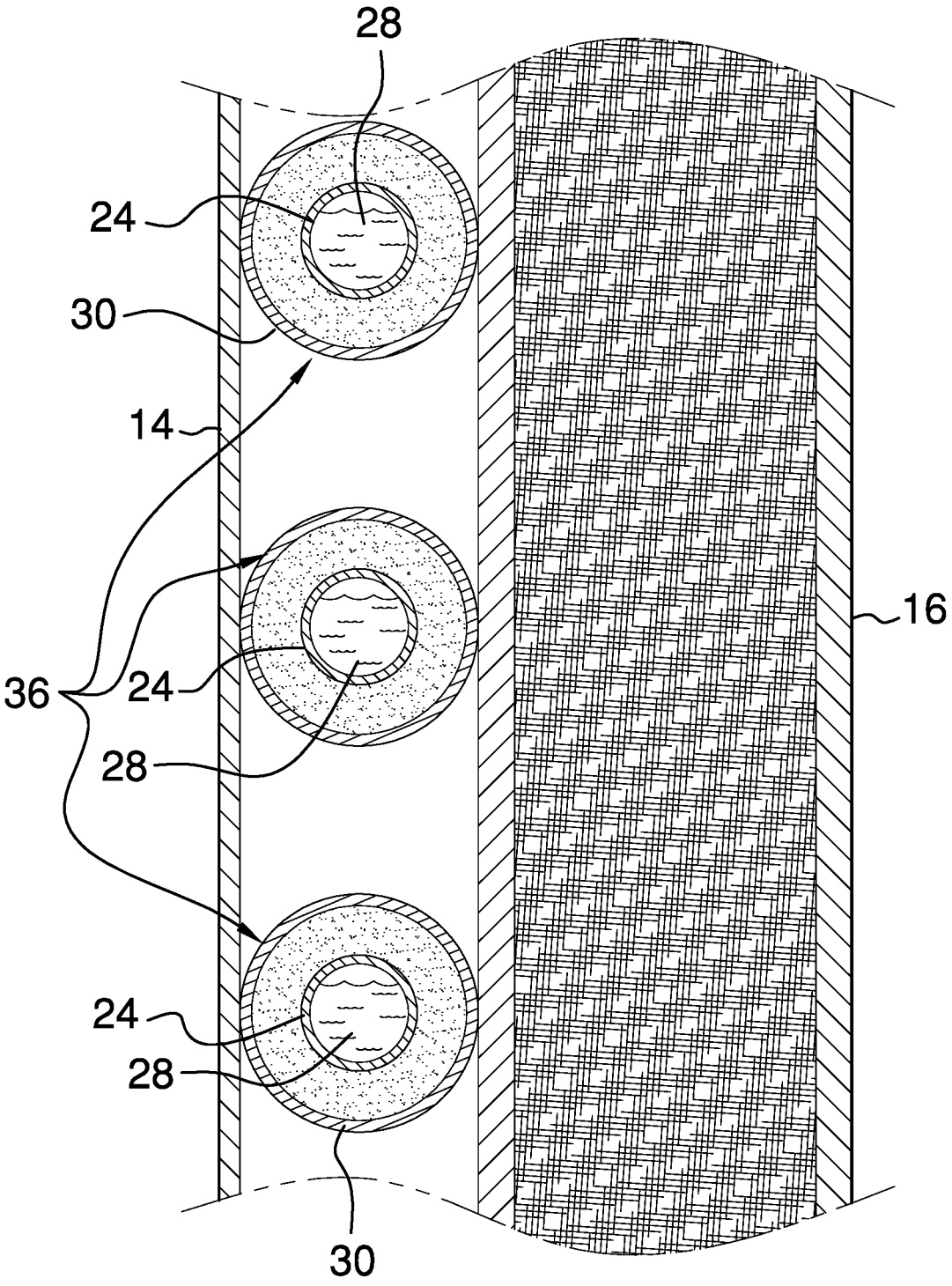
FIG. 5 is a cross sectional view taken along line 5-5 of FIG. 2 of an embodiment of the disclosure.
Figure 6:
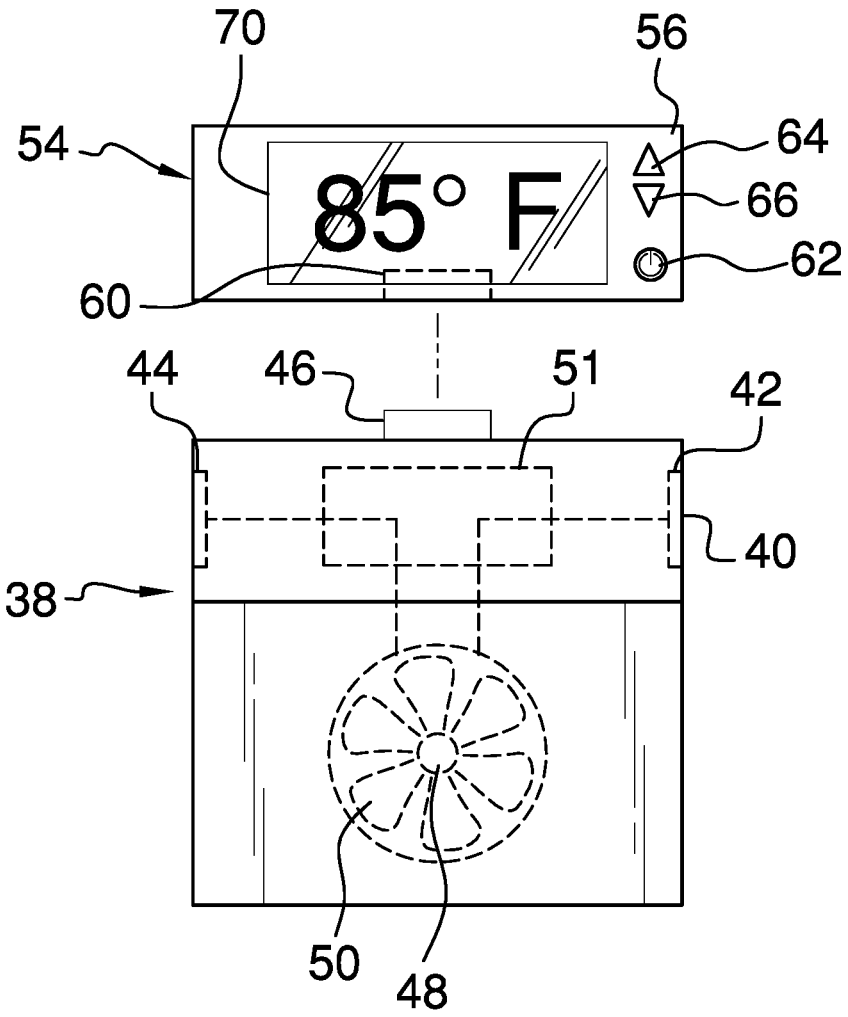
FIG. 6 is an exploded perspective view of a temperature conditioning unit and a control unit of an embodiment of the disclosure.
Figure 7:
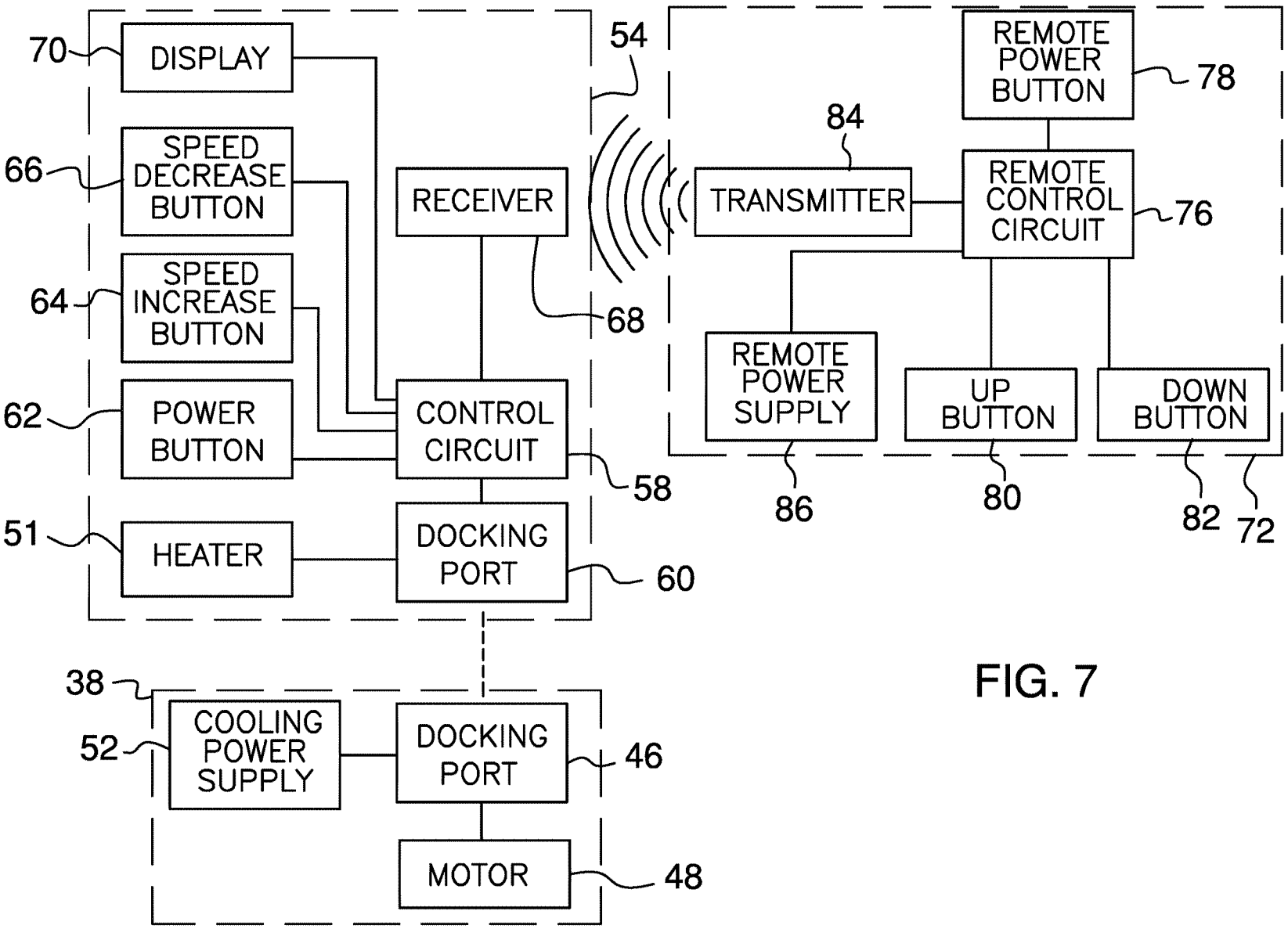
FIG. 7 is a schematic view of an embodiment of the disclosure.

With reference now to the drawings, and in particular to FIGS. 1 through 7 thereof, a new vest cooling device embodying the principles and concepts of an embodiment of the disclosure and generally designated by the reference numeral 10 will be described.

As best illustrated in FIGS. 1 through 7, the ballistic vest cooling assembly 10 generally comprises a ballistic vest 12 that is comprised of a bullet resistant material to protect a user from a bullet. The bullet resistant material may include Kevlar, Spectra Shield or any other material that is conventional to ballistic vests. Additionally, the ballistic vest 12 may have a design that is common to ballistic vests worn by military or police. The ballistic vest 12 has an inwardly facing surface 14, an outwardly facing surface 16 and a rear panel 18. The inwardly facing surface 14 rests against the user when the ballistic vest 12 is worn and the rear panel 18 lies against the user's back when the ballistic vest 12 is worn. A pocket 20 is integrated into the ballistic vest 12, the pocket 20 has an upper end 22, the upper end 22 is open into an interior of the pocket 20 and the pocket 20 is positioned on the rear panel 18 of the ballistic vest 12.

A plurality of tubes 24 is each integrated into the ballistic vest 12 and each of the tubes 24 is in thermal communication with the ballistic vest 12. Each of the tubes 24 is in fluid communication with each other to define a network of tubes 26 that completely surrounds the ballistic vest 12. The plurality of tubes 24 contains a fluid 28 that is highly thermally conductive, such as water or the like. Each of the tubes 24 is aligned with the inwardly facing surface 14 of the ballistic vest 12 such that the plurality of tubes 24 is in thermal communication with the user's body when the user wears the ballistic vest 12. Additionally, a sleeve 30 is positioned around each of the plurality of tubes 24 to define an air space between the sleeve 30 and the plurality of tubes 24, and the sleeve 30 has an inlet 32 and an outlet 34. The sleeve 30 comprises a network of sleeves 36 that completely surrounds the network of tubes 26.

A temperature conditioning unit 38 is provided and the temperature conditioning unit 38 coupled to the ballistic vest 12. The temperature conditioning unit 38 is in fluid communication with the sleeve 30 and the temperature conditioning unit 38 blows air through the sleeve 30 when the temperature conditioning unit 38 is turned on. In this way the fluid in the tubes 24 can either be cooled or heated when the user wears the ballistic vest 12. Thus, the user's comfort is enhanced when the user wears the ballistic vest 12 for extended periods of time with respect to keeping the user's body cool or warm.

The temperature conditioning unit 38 comprises a housing 40 that has an intake 42 and an exhaust 44. The inlet 32 of the sleeve 30 is fluidly coupled to the exhaust 44 and the outlet 34 of the sleeve 30 is fluidly coupled to the intake 42. Additionally, the housing 40 is positioned in the pocket 20 on the ballistic vest 12. A docking port 46 is coupled to the housing 40, a motor 48 is positioned within the housing 40 and the motor 48 is electrically coupled to the docking port 46. The motor 48 may be an electric motor 48 or the like. A fan 50 is rotatably coupled to the motor 48 and the fan 50 is in fluid communication with the exhaust 44. The fan 50 urges air outwardly through the exhaust 44 and through the sleeve 30 when the motor 48 is turned for cooling the fluid 28 in the tubes 24. In this way the fan 50 enhances cooling the user when the user wears the ballistic vest 12.

A heater 51 is positioned within the housing 40 and the heater 51 is electrically coupled to the docking port 46. The heater 51 is in thermal communication with an interior of the housing 40 such that the heater 51 heats the air in the housing 40 when the heater 51 is turned on. Thus, the fan 50 urges the heated air outwardly through the exhaust 44 to heat the fluid 28 in the tubes 24. In this way the fan 50 warms the user when the user wears the ballistic vest 12. A power supply 52 is coupled to the housing 40, the power supply 52 is electrically coupled to the docking port 46 and the power supply 52 comprises at least one battery.

A control unit 54 is provided and the control circuit 58 is selectively placed in electrical communication with the temperature conditioning unit 38 for turning the temperature conditioning unit 38 on and off. The control unit 54 comprises a control housing 56 and a control circuit 58 that is positioned within the control housing 56. A docking port 60 is coupled to the control housing 56 and the docking port 60 on the control housing 56 is electrically coupled to the control circuit 58. Additionally, the docking port 60 on the control housing 56 engages the docking port 46 on the housing 40 when the control housing 56 is positioned in the pocket 20 on the ballistic vest 12. In this way the control circuit 58 is in electrical communication with the motor 48 in the housing 40 and the heater 51. The control unit may include a heat button for turning the heater 51 on and off. The heater may be an electric heater of any conventional design and the docking port 60, 46 on each of the cooling 40 and control 56 housings may be complementary usb ports or any other type of complementary electrical port.

A power button 62 is coupled to the control housing 56 and the power button 62 is electrically coupled to the control circuit 58. The control circuit 58 turns the motor 48 on when the power button 62 is manipulated and the control housing 56 is docked with the housing 40. A speed increase button 64 is coupled to the control housing 56 and the speed increase button 64 is electrically coupled to the control circuit 58. The control circuit 58 increases a rotational speed of the motor 48 when the speed increase button 64 is manipulated to increase the rate of heat transfer between the user and the fluid in the tubes 24. A speed decrease button 66 is coupled to the control housing 56 and the speed decrease button 66 is electrically coupled to the control circuit 58. The control circuit 58 decreases a rotational speed of the motor 48 when the speed decrease button 66 is manipulated to decrease the rate of heat transfer between the user and the fluid in the tubes 24.

A receiver 68 is coupled to the control housing 56 and the receiver 68 is electrically coupled to the control circuit 58. The receiver 68 may be a radio frequency receiver or the like. A display 70 is coupled to the control housing 56, the display 70 is electrically coupled to the control circuit 58 and the display 70 displays indicia comprising operational parameters of the control circuit 58. The display 70 may be an LED or other type of electronic display.

A remote control 72 is provided and the remote control 72 is in wireless electrical communication with the control unit 54 for remotely controlling the temperature conditioning unit 38. The remote control 72 comprises a remote control housing 74 and a remote control circuit 76 that is positioned within the remote control housing 74. A remote power button 78 is coupled to the remote control housing 74 and the remote power button 78 is electrically coupled to the remote control circuit 76. An up button 80 is coupled to the remote control housing 74 and the up button 80 is electrically coupled to the remote control circuit 76. Additionally, a down button 82 is coupled to the remote control housing 74 and the down button 82 is electrically coupled to the remote control circuit 76.

A transmitter 84 is positioned within the remote control housing 74, the transmitter 84 is electrically coupled to the remote control circuit 76 and the transmitter 84 is in electrical communication with the receiver 68 in the control unit 54. The transmitter 84 communicates an on command to the control circuit 58 when the remote power button 62 is manipulated for remotely turning on the motor 48 in the temperature conditioning unit 38. Additionally, the transmitter 84 communicates an increase command to the control circuit 58 when the up button 80 is manipulated for remotely increasing the rotational speed of the motor 48. The transmitter 84 communicates a decrease command to the control circuit 58 when the down button 82 is manipulated for remotely decreasing the rotational speed of the motor 48. The transmitter 84 may be a radio frequency transmitter 84 or the like and the transmitter 84 may have an operational range of less than 100.0 feet. A remote power supply 86 is positioned within the remote control 74 housing, the remote power supply 86 is electrically coupled to the remote control circuit 76 and the remote power supply 86 comprises at least one battery.

In use, the ballistic vest 12 is worn during military or police actions thusly placing the plurality of tubes 24 in thermal communication with the user's body. The control housing 56 is positioned in the pocket 20 and the docking port 60 on the control housing 56 engages the docking port 46 on the housing 40. Thus, the power button 62, the speed increase button 64 and the speed decrease button 66 controls the motor 48 in the housing 40. The fan 50 blows air through the sleeve 30 and thusly enhance thermal communication between the user's body and the fluid 28 in the tubes 24. In this way the user's body is cooled when the ballistic vest 12 is being worn for enhancing the user's comfort. The heater can be turned on to heat the fluid 28 in the tubes when the ballistic vest 12 is being worn in a cold environment to help keep the user warm.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ballistic vest cooling assembly being configured to cool a user while the user wears a ballistic vest, said assembly comprising: a ballistic vest being comprised of a bullet resistant material wherein said ballistic vest is configured to protect a user from a bullet; a plurality of tubes, each of said tubes being integrated into said ballistic vest, each of said tubes being in thermal communication with said ballistic vest, each of said tubes being in fluid communication with each other to define a network of tubes that completely surround said ballistic vest, said plurality of tubes containing a fluid; a sleeve being positioned around said plurality of tubes to define an air space between said sleeve and said plurality of tubes; a temperature conditioning unit being coupled to said ballistic vest, said temperature conditioning unit being in fluid communication with said sleeve, said temperature conditioning unit blowing air through said sleeve when said temperature conditioning unit is turned on for cooling said fluid in said tubes wherein said temperature conditioning unit is configured to cool the user when the user wears said ballistic vest; a control unit being selectively placed in electrical communication with said temperature conditioning unit for turning said temperature conditioning unit on and off; a remote control being in wireless electrical communication with said control unit for remotely controlling said temperature conditioning unit; said ballistic vest having an inwardly facing surface, an outwardly facing surface and a rear panel, said inwardly facing surface resting against the user when said ballistic vest is worn, said rear panel lying against the user's back when said ballistic vest is worn; a pocket being integrated into said ballistic vest, said pocket having an upper end, said upper end being open into an interior of said pocket, said pocket being positioned on said rear panel of said ballistic vest; each of said tubes being aligned with said inwardly facing surface of said ballistic vest wherein said plurality of tubes is configured to be in thermal communication with the user's body when the user wears said ballistic vest; said sleeve having an inlet and an outlet; and said temperature conditioning unit comprising a housing having an intake and an exhaust, said inlet of said sleeve being fluidly coupled to said exhaust, said outlet of said sleeve being directly fluidly coupled to said intake, said housing being positioned in said pocket on said ballistic vest.

2. The assembly according to claim 1, further comprising:

a docking port being coupled to said housing;

a motor being positioned within said housing, said motor being electrically coupled to said docking port;

a fan being rotatably coupled to said motor, said fan being aligned with said exhaust, said fan urging air outwardly through said exhaust and through said sleeve when said motor is activated wherein said fan is configured to enhance cooling the user when the user wears said ballistic vest; and a power supply being coupled to said housing, said power supply being electrically coupled to said docking port said power supply comprising at least one battery.

3. The assembly according to claim 2, wherein said control unit comprises:

a control housing;

a control circuit being positioned within said control housing;

a docking port being coupled to said control housing, said docking port on said control housing being electrically coupled to said control circuit, said docking port on said control housing engaging said docking port on said housing when said control housing is positioned in said pocket on said ballistic vest such that said control circuit is in electrical communication with said motor in said housing.

4. The assembly according to claim 3, further comprising:

a power button being coupled to said control housing, said power button being electrically coupled to said control circuit, said control circuit turning said motor on when said power button is manipulated;

a speed increase button being coupled to said control housing, said speed increase button being electrically coupled to said control circuit, said control circuit increasing a rotational speed of said motor when said speed increase button is manipulated wherein said fan is configured to increase the rate of heat transfer between the user and said fluid in said tubes; and a speed decrease button being coupled to said control housing, said speed decrease button being electrically coupled to said control circuit, said control circuit decreasing a rotational speed of said motor when said speed decrease button is manipulated wherein said fan is configured to decrease the rate of heat transfer between the user and said fluid in said tubes.

5. The assembly according to claim 3, further comprising:

a receiver being coupled to said control housing, said receiver being electrically coupled to said control circuit; and a display being coupled to said control housing, said display being electrically coupled to said control circuit, said display displaying indicia comprising operational parameters of said control circuit.

6. The assembly according to claim 5, wherein said remote control comprising:

a remote control housing;

a remote control circuit being positioned within said remote control housing;

a remote power button being coupled to said remote control housing, said remote power button being electrically coupled to said remote control circuit;

an up button being coupled to said remote control housing, said up button being electrically coupled to said remote control circuit; and a down button being coupled to said remote control housing, said down button being electrically coupled to said remote control circuit.

7. The assembly according to claim 6, further comprising a transmitter being positioned within said remote control housing, said transmitter being electrically coupled to said remote control circuit, said transmitter being in electrical communication with said receiver in said control unit, said transmitter communicating an on command to said control circuit when said remote power button is manipulated for remotely turning on said motor in said temperature conditioning unit, said transmitter communicating an increase command to said control circuit when said up button is manipulated for remotely increasing the rotational speed of said motor; said transmitter communicating a decrease command to said control circuit when said down button is manipulated for remotely decreasing the rotational speed of said motor.

8. The assembly according to claim 7, further comprising a remote power supply being positioned within said remote housing, said remote power supply being electrically coupled to said remote control circuit, said remote power supply comprising at least one battery.

9. A ballistic vest cooling assembly being configured to cool a user while the user wears a ballistic vest, said assembly comprising: a ballistic vest being comprised of a bullet resistant material wherein said ballistic vest is configured to protect a user from a bullet, said ballistic vest having an inwardly facing surface, an outwardly facing surface and a rear panel, said inwardly facing surface resting against the user when said ballistic vest is worn, said rear panel lying against the user's back when said ballistic vest is worn; a pocket being integrated into said ballistic vest, said pocket having an upper end, said upper end being open into an interior of said pocket, said pocket being positioned on said rear panel of said ballistic vest; a plurality of tubes, each of said tubes being integrated into said ballistic vest, each of said tubes being in thermal communication with said ballistic vest, each of said tubes being in fluid communication with each other to define a network of tubes that completely surround said ballistic vest, said plurality of tubes containing a fluid, each of said tubes being aligned with said inwardly facing surface of said ballistic vest wherein said plurality of tubes is configured to be in thermal communication with the user's body when the user wears said ballistic vest; a sleeve being positioned around said plurality of tubes to define an air space between said sleeve and said plurality of tubes, said sleeve having an inlet and an outlet; a temperature conditioning unit being coupled to said ballistic vest, said temperature conditioning unit being in fluid communication with said sleeve, said temperature conditioning unit blowing air through said sleeve when said temperature conditioning unit is turned on for cooling said fluid in said tubes wherein said temperature conditioning unit is configured to cool the user when the user wears said ballistic vest, said temperature conditioning unit comprising: a housing having an intake and an exhaust, said inlet of said sleeve being fluidly coupled to said exhaust, said outlet of said sleeve being directly fluidly coupled to said intake, said housing being positioned in said pocket on said ballistic vest; a docking port being coupled to said housing; a motor being positioned within said housing, said motor being electrically coupled to said docking port; a fan being rotatably coupled to said motor, said fan being aligned with said exhaust, said fan urging air outwardly through said exhaust and through said sleeve when said motor is activated wherein said fan is configured to enhance cooling the user when the user wears said ballistic vest; a power supply being coupled to said housing, said power supply being electrically coupled to said docking port, said power supply comprising at least one battery; a control unit being selectively placed in electrical communication with said temperature conditioning unit for turning said temperature conditioning unit on and off, said control unit comprising: a control housing; a control circuit being positioned within said control housing; a docking port being coupled to said control housing, said docking port on said control housing being electrically coupled to said control circuit, said docking port on said control housing engaging said docking port on said housing when said control housing is positioned in said pocket on said ballistic vest such that said control circuit is in electrical communication with motor in said housing; a power button being coupled to said control housing, said power button being electrically coupled to said control circuit, said control circuit turning said motor on when said power button is manipulated; a speed increase button being coupled to said control housing, said speed increase button being electrically coupled to said control circuit, said control circuit increasing a rotational speed of said motor when said speed increase button is manipulated wherein said fan is configured to increase the rate of heat transfer between the user and said fluid in said tubes; a speed decrease button being coupled to said control housing, said speed decrease button being electrically coupled to said control circuit, said control circuit decreasing a rotational speed of said motor when said speed decrease button is manipulated wherein said fan is configured to decrease the rate of heat transfer between the user and said fluid in said tubes; a receiver being coupled to said control housing, said receiver being electrically coupled to said control circuit; and a display being coupled to said control housing, said display being electrically coupled to said control circuit, said display displaying indicia comprising operational parameters of said control circuit; and a remote control being in wireless electrical communication with said control unit for remotely controlling said temperature conditioning unit, said remote control comprising: a remote control housing; a remote control circuit being positioned within said remote control housing; a remote power button being coupled to said remote control housing, said remote power button being electrically coupled to said remote control circuit; an up button being coupled to said remote control housing, said up button being electrically coupled to said remote control circuit; a down button being coupled to said remote control housing, said down button being electrically coupled to said remote control circuit; a transmitter being positioned within said remote control housing, said transmitter being electrically coupled to said remote control circuit, said transmitter being in electrical communication with said receiver in said control unit, said transmitter communicating an on command to said control circuit when said remote power button is manipulated for remotely turning on said motor in said temperature conditioning unit, said transmitter communicating an increase command to said control circuit when said up button is manipulated for remotely increasing the rotational speed of said motor; said transmitter communicating a decrease command to said control circuit when said down button is manipulated for remotely decreasing the rotational speed of said motor; and a remote power supply being positioned within said remote housing, said remote power supply being electrically coupled to said remote control circuit, said remote power supply comprising at least one battery.

* * * * *